US009708884B2

(12) United States Patent
Epstein

(10) Patent No.: US 9,708,884 B2
(45) **Date of Patent: *Jul. 18, 2017**

(54) SACRIFICIAL ISOLATION MEMBER FOR FRACTURING SUBSURFACE GEOLOGIC FORMATIONS

(71) Applicant: Jeffrey Stephen Epstein, Houston, TX (US)

(72) Inventor: Jeffrey Stephen Epstein, Houston, TX (US)

(73) Assignee: Jeffrey Stephen Epstein, Houston, TX (US)

( * ) Notice: Subject to any disclaimer, the term of this patent is extended or adjusted under 35 U.S.C. 154(b) by 92 days.

This patent is subject to a terminal disclaimer.

(21) Appl. No.: 14/741,182

(22) Filed: Jun. 16, 2015

(65) Prior Publication Data

US 2015/0275616 A1 Oct. 1, 2015

Related U.S. Application Data

(63) Continuation-in-part of application No. 14/521,662, filed on Oct. 23, 2014.

(60) Provisional application No. 61/898,088, filed on Oct. 31, 2013.

(51) Int. Cl.

| | |
|---|---|
| ***E21B 33/134*** | (2006.01) |
| ***E21B 43/263*** | (2006.01) |
| ***E21B 34/06*** | (2006.01) |

(52) U.S. Cl.

CPC ..... *E21B 33/134* (2013.01); *E21B 34/063* (2013.01); *E21B 43/263* (2013.01)

(58) Field of Classification Search

CPC ..... E21B 43/26; E21B 43/263; E21B 34/063; E21B 47/06

See application file for complete search history.

(56) References Cited

U.S. PATENT DOCUMENTS 8,397,813 B2 * 3/2013 Brandsdal ..... E21B 33/134 166/192
8,714,251 B2 * 5/2014 Glenn ..... E21B 17/07 166/297

(Continued)

*Primary Examiner* — Giovanna C Wright
*Assistant Examiner* — Jonathan Malikasim
(74) *Attorney, Agent, or Firm* — Patrick K. Steele; Jeffrey L. Streets

(57) ABSTRACT

An embodiment of an isolation member cooperates with an isolation member seat to isolate a well first portion of an earthen well drilled into the earth's crust from a well second portion and comprises an interior chamber to receive an explosive charge. The explosive charge may be surrounded by a filler material that is resistant to deformation. A pressure sensor, a circuit, and a battery are also received into the chamber. The isolation member material may comprise one of zirconium oxide, aluminum oxide, bulk metallic glass, silicon nitride or tungsten carbide, and the isolation member is resistant to deformation within the isolation member seat under the application of a substantial pressure differential across the isolation member and isolation member seat. Detonation of the explosive charge fragments the isolation member to prevent the isolation member from presenting an obstruction to subsequent well operations. A safety fuse may be included to enable safe handling and transport.

20 Claims, 6 Drawing Sheets

(56) References Cited

U.S. PATENT DOCUMENTS

| | | | | |
|---|---|---|---|---|
| 2004/0020643 | A1* | 2/2004 | Thomeer | E21B 47/01 166/250.01 |
| 2012/0181032 | A1* | 7/2012 | Naedler | E21B 43/26 166/308.1 |
| 2012/0305313 | A1* | 12/2012 | DiFoggio | E21B 47/06 175/45 |
| 2013/0032357 | A1* | 2/2013 | Mazyar | E21B 41/00 166/376 |
| 2014/0158356 | A1* | 6/2014 | Andrzejak | E21B 43/263 166/297 |

* cited by examiner

SACRIFICIAL ISOLATION MEMBER FOR FRACTURING SUBSURFACE GEOLOGIC FORMATIONS

STATEMENT OF RELATED APPLICATIONS

This continuation-in-part application depends from and claims priority to U.S. Non-Provisional Application Ser. No. 14/521,662 filed on Oct. 23, 2014 which, in turn, claims priority to U.S. Provisional Application No. 61/898,088 filed on Oct. 31, 2013.

BACKGROUND

Field of the Invention

The present invention relates to an improved sacrificial isolation member for use with an isolation member seat to fluidically isolate a first portion of a well casing from a second portion of a well casing to expose a targeted geologic zone for hydraulic fracturing operations to enhance recovery and the rate of production of hydrocarbons from a well that penetrates the targeted geologic zone.

Background of the Related Art

Hydraulic fracturing is the fracturing of rock by a pressurized liquid. Some hydraulic fractures form naturally. Induced hydraulic fracturing or hydro-fracturing, commonly known as "fracking," is a technique in which a fluid, typically water, is mixed with a proppant and chemicals to form a mixture that is injected at high pressure into a well to create small fractures in a hydrocarbon-bearing geologic formation along which the hydrocarbon fluids such as gas, oil or condensate may migrate to the well for production to the surface. Hydraulic pressure is removed from the well, then small grains of the proppant, for example, sand or aluminum oxide, hold the fractures open once the formation pressure achieves an equilibrium. The technique is commonly used in wells for shale gas, tight gas, tight oil, coal seam gas and hard rock wells. This well stimulation technique is generally only conducted once in the life of the well and greatly enhances fluid removal rates and well productivity.

A hydraulic fracture is formed by pumping fracturing fluid into a perforated section of the well at a rate sufficient to increase pressure downhole at the target zone (determined by the location of the well casing perforations) to exceed that of the fracture gradient (pressure gradient) of the rock. The fracture gradient is defined as the pressure increase per unit of the depth due to its density and it is usually measured in pounds per square inch per foot or bars per meter. The rock cracks and the fracture fluid continues further into the rock, extending the crack still further, and so on. Fractures are localized because pressure drop off with frictional loss attributed to the distance from the well. Operators typically try to maintain "fracture width," or slow its decline, following treatment by introducing into the injected fluid a proppant—a material such as grains of sand, ceramic beads or other particulates that prevent the fractures from closing when the injection is stopped and the pressure of the fluid is removed. The propped fracture is permeable enough to allow the flow of formation fluids to the well. Formation fluids include gas, oil, salt water and fluids introduced to the formation during completion of the well during fracturing.

The location of one or more fractures along the length of the borehole is strictly controlled by various methods that create or seal off holes in the side of the well. A well may be fracked in stages by setting an isolation member seat, such as a ball seat or a plug seat, below the geologic formation to be fracked to isolate one or more lower geologic zones open to the well from the anticipated pressure to be later applied to a zone closer to the surface. An isolation member, such as, for example, a dart, a ball or a plug of a predetermined diameter and/or profile is introduced into the well to engage the corresponding isolation member seat. When the isolation member engages the isolation member seat installed in the bore of the well casing, the isolation member seats in the isolation member seat to form a seal that isolates the first portion of the casing below the seat from the hydraulic fracturing pressure to be imposed on a geologic formation zone in fluid communication with the second portion of the casing having perforations above the seat.

Hydraulic-fracturing equipment used in oil and natural gas fields usually consists of a slurry blender, one or more high-pressure, high-volume fracturing pumps (typically powerful triplex or quintuplex pumps) and a monitoring unit. Associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure. Chemical additives are typically 0.5% percent of the total fluid volume. Fracturing equipment operates over a range of pressures and injection rates, and can reach up to 100 megapascals (15,000 psi) and 265 liters per second (9.4 cu. ft./sec or 100 barrels per min.).

A problem that can be encountered in a fracking operation involves the impairment to subsequent operations that can result from the presence of the isolation member engaged with the isolation member seat. After the fracking operation is concluded, the surface pressure is restored to a pressure at which the well will flow and produce formation fluids to the surface for recovery. An isolation member to be used for fracking and having a sufficiently low density can be floated or back-flowed from the well, but an isolation member having a low density may be deformed by the large pressure differential applied across the isolation member and the cooperating isolation member seat. Unwanted deformation of the isolation member may compromise the effectiveness of the fracturing operations. If the isolation member is of a material that is more dense so that it can not be floated or back-flowed from the well to the surface, then the isolation member may present an unwanted well obstruction that must be removed from the well to prevent impairment of subsequent well operations.

A workover operation can be implemented in which a drilling instrument is introduced into the well to drill out and to mechanically destroy the isolation member, but a workover operation requires that a workover rig be brought to the surface location of the well for downhole operations. The need for the rental, transportation, rigging up and use of a rig imposes substantial delays and substantial costs.

What is needed is an isolation member that can be used for fracking and that has a sufficient density and resistance to deformation so that it can be used in conjunction with a corresponding seat to reliably isolate geologic formation zones below the seat from anticipated large fracturing pressures applied to geologic formation zones above the seat and that does not impair subsequent well operations.

BRIEF SUMMARY

One embodiment of the present invention provides an isolation member for use in fracking to seal with a corresponding isolation member seat that is secured in a position in a well. The isolation member contains an explosive charge for fragmenting the isolation member after use. The fracking ball is constructed in a manner that provides sufficient resistance to deformation of the isolation member as a large pressure differential is applied across the isolation member and the corresponding isolation member seat.

An embodiment of the present invention provides a fracking isolation member such as, for example, a ball, a dart or a plug, that can be fragmented by detonation of an explosive charge provided within an interior chamber of the isolation member to produce, upon detonation of the explosive charge, a plurality of isolation member fragments that do not interfere with subsequent well operations. In one embodiment of the isolation member of the present invention, the use of a ceramic spherical body provides sufficient resistance to deformation under large pressure differentials across the isolation member and the corresponding isolation member seat applied during fracking operations. In addition, these materials can provide for favorable fragmentation of the isolation member upon detonation of the explosive charge stored within an interior chamber of the isolation member to prevent unwanted obstacles having a substantial size from obstructing flow in the well.

In one embodiment of the isolation member of the present invention, a battery, a pressure sensor and a circuit are included within an interior chamber of the isolation member along with an explosive charge. The pressure sensor is disposed in fluid communication with an exterior surface of the isolation member through an aperture in the ceramic structure. The pressure sensor detects a predetermined pressure threshold and initiates a predetermined timer delay period prior to detonation. Upon elapse of the predetermined timer delay period, a circuit is completed that generates an electrical current from the battery to the explosive charge to detonate the explosive charge and to thereby fragment the isolation member. In one embodiment in which the isolation member is a dissolvable isolation member, the fragmentation of the isolation member dramatically increases the aggregated surface area exposed to the fluids in the well to provide a much more rapid rate of dissolution as compared to a dissolvable isolation member that is not fragmented.

The higher fracking pressures achievable by use of embodiments of the fracking isolation member of the present invention, along with the lack of obstruction of subsequent well operations due to fragmentation, increase the success and effectiveness of the fracking process, lowers or eliminates workover rig rental costs, and prevents unwanted delays in subsequent well operations after the fracking process.

DETAILED DESCRIPTION

Figure 1:
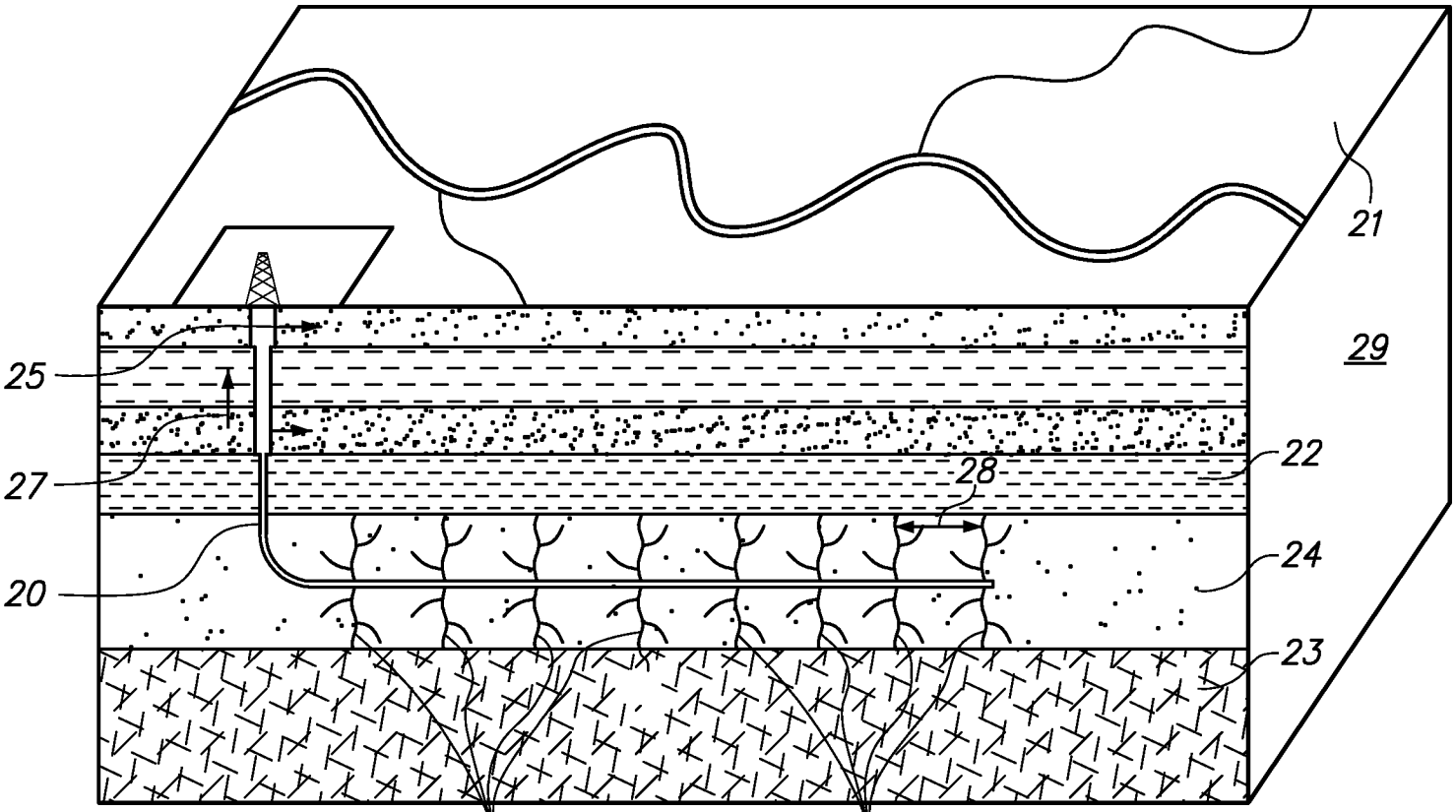
FIG. 1 is a sectional view of a well drilled into the earth's crust and illustrating a series of hydraulic fractures disposed at a predetermined spacing to enhance production and recovery of formation fluids from a hydraulically fractured subsurface geologic formation.

One embodiment of the present invention provides an isolation member having an outer surface of sufficient smoothness to enable the isolation member to seat within and to seal with a corresponding isolation member seat, wherein the isolation member has substantial resistance to deformation by an applied pressure differential across the seal created by the isolation member received within the isolation member seat. The embodiment of the isolation member contains an explosive device that can be detonated to destroy the isolation member from within and to thereby fragment the isolation member into a large plurality of small fragments. The embodiment of the isolation member may include a filler material received within a hollow interior chamber of the isolation member, along with the explosive device, wherein the filler material comprises a non-compressible fluid such as, for example, a gel, or particles or pieces of such a small size that they can be released in the well without concern for the particles or pieces presenting a well obstruction or interfering with the function or operation of any downhole components that might be contacted. The filler material may comprise one of sand, ceramic beads or some other filler material that exhibits substantial resistance to deformation and resistance to compression. The filler material may also comprise an incompressible fluid, such as water. It will be understood that the temperature at which the isolation member will reside prior to detonation of the explosive charge should be considered when choosing a filler material as an incompressible fluid may result in excessive internal pressure at elevated temperatures.

The manner in which an embodiment of the isolation member of the present invention is made may vary, but will generally include the steps of providing a ceramic outer shell having a hollow interior and, optionally, a hole through which a pressure sensor may be inserted into the isolation member. An embodiment of a fracking isolation member of the present invention may include an explosive device and a filler material that can be disposed within the hollow interior chamber. In one embodiment of the isolation member having a spherical exterior, a first hemispherical portion and a second hemispherical portion may be secured one to the other to form a spherical ball which can engage and seal with an isolation member having a generally circular ball seat. In an alternate embodiment of the isolation member, the isolation member may include a generally cylindrical exterior, such as a dart, having an outer surface adapted to sealably engage an isolation member seat having a tapered guide to steer the leading portion of the dart into a generally circular aperture (in cross-section) to seal with the dart. In another alternate embodiment of the isolation member, the isolation member may include a generally truncated frusto-conical exterior portion, such as a tapered plug, to engage and seal with an isolation member having a correspondingly frusto-conical plug seat. It will be understood that the isolation member may include a variety of exterior shapes that can be adapted to engage and seal with a correspondingly shaped isolation member seat. Spherical, tapered and cylindrical structures are advantageous because these shapes can be conveniently guided into engagement with the sealing portion of the isolation member seat. Although, the appended drawings illustrate an apparatus of the present invention having a spherical isolation member, the appended drawings merely illustrate a function that can be provided by other isolation members with alternate exterior shapes and configurations. The appended drawings are merely for illustration and should not be considered as limiting of the invention.

As illustrated in the appended drawings, an embodiment of the apparatus of the present invention may include a ceramic sphere consisting of two or more hemispherical portions secured together along an interface to form a sphere. In another embodiment, the ceramic sphere consists of a unitary spherical body having an aperture or hole through which components, such as, for example, a safety fuse and a pressure sensor to enable the explosive charge, a battery, a processor and non-compressive filler material may be inserted. It will be understood that isolation members having other configurations may also be assembled from mating ceramic components to form a closed chamber to contain the components.

Embodiments of an apparatus of the present invention may further include a timer-controlled detonator. The pressure sensor may be provided to generate a signal that enables or initiates the electrical circuit that delivers a detonating current flow from a battery to the explosive charge. The provision of the pressure sensor to complete and thereby enable the circuit causes the pressure sensor to function as a safety fuse without which the apparatus would be unable to self-destruct.

In one embodiment, the ceramic outer shell of embodiments of the apparatus may comprise one of zirconium oxide, silicon nitride, tungsten carbide, zirconia toughened alumina, bulk metallic glass (BMG) and aluminum oxide. The high compressive strengths of these ceramic materials enable the isolation member to reliably seat in the isolation member seat and withstand high hydraulic fracturing pressures. Embodiments of the apparatus of the present invention may include a ceramic outer shell, or mating components that together make up a ceramic outer shell, that can be manufactured by, for example, but not by way of limitation, isostatic pressing, hot isostatic processing (HIP), injection molding, slip casting or gel casting techniques.

In one embodiment, a ceramic outer shell, or mating components of a ceramic outer shell, comprising zirconia with a very thin wall thickness of only 0.060 inches can be gel cast and subsequently hot isostatically pressed to increase the flexural strength of the isolation member so it can be seated in the isolation member seat to withstand very high differential pressures while yielding less fragmented debris after fragmentation by detonation of the explosive charge. Less debris results in a lower probability of debris fragments interfering with or obstructing other downhole equipment later used in fracking other zones in the well.

FIG. 1 is a sectional view of a well 20 drilled from the surface 21 into the earth's crust 29 and illustrating a series of proposed hydraulic fractures 26 disposed at a predetermined spacing 28 to enhance production and recovery of formation fluids from a hydraulically fractured subsurface geologic formation 24. The drilled well 20 may include a mono-bore or multiple layers of decreasing diameters of casing as is known in the art.

The well 20 may include one or more turns or changes in direction to align the portion of the well 20 to be perforated or otherwise to gather fluids within a known geological structure, seam or formation 24. The fractures 26 created in the formation 24 are generally disposed at a predetermined spacing 28 selected for optimal drainage. The targeted formation 24 may reside between a top layer 22 and an underlying layer 23 within the earth's crust 29. It will be understood that fluids entering the well 20 flow according to a pressure gradient in the direction of the arrow 27 to the surface for processing, storage or transportation.

Figure 2:
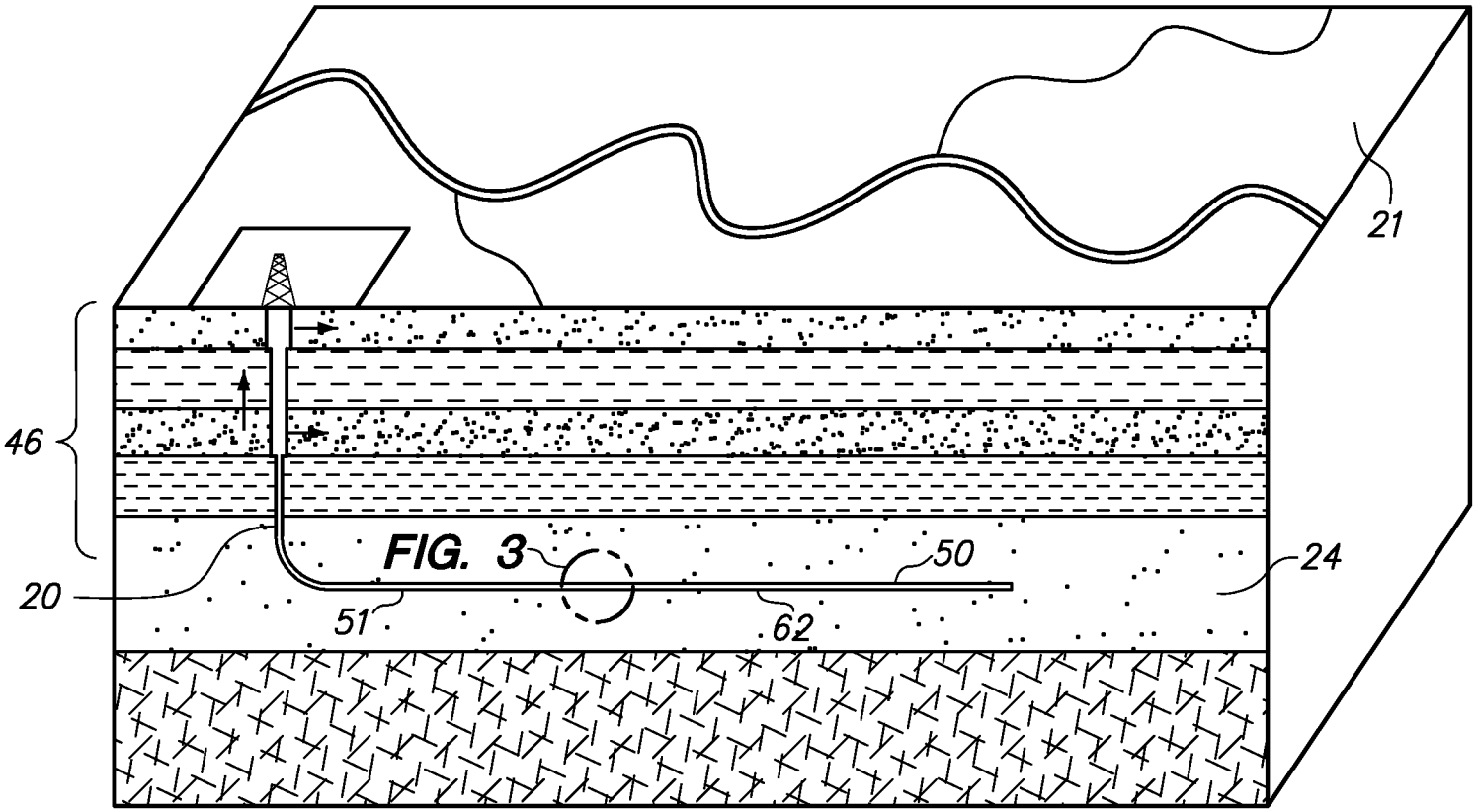
FIG. 2 is the sectional view of the well of FIG. 1 illustrating the lack of fractures within the targeted geologic formation prior to the creation of the hydraulic fractures and illustrating a location of a desired placement of an isolation member and an isolation member seat to receive the isolation member to thereby isolate zones deeper in the well than the isolation member seat (to the right in FIG. 2) from zones shallower in the well than the ball seat (to the left in FIG. 2).

FIG. 2 is the sectional view of the well 20 of FIG. 1 prior to hydraulic fractures 26 (seen in FIG. 1) are formed in the targeted geologic formation 24. FIG. 2 illustrates, using a circle, a location of a desired placement of an isolation member seat (not shown) to receive an isolation member (not shown) to isolate a portion 50 of the well 20, that is deeper in the well than the isolation member seat (i.e., to the right in FIG. 2) from an uphole portion 51 of the well 20 (i.e., to the left in FIG. 2). The isolation member and the isolation member seat are to be placed in a portion 62 of the well 20 that lies within the targeted geologic formation 24.

Figure 3:
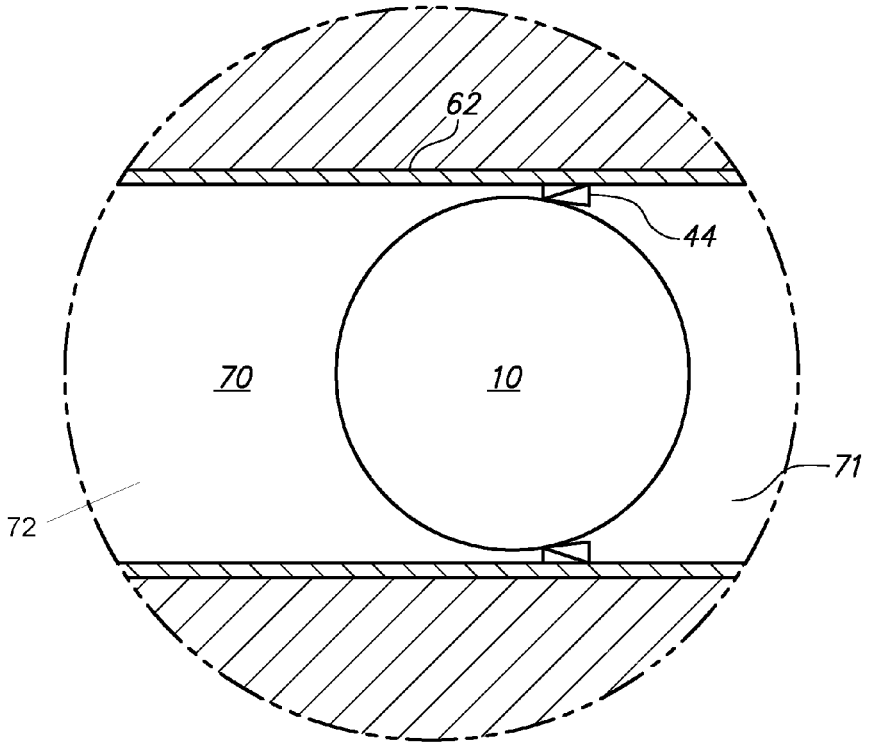
FIG. 3 is a sectional elevation of an embodiment of an isolation member of the present invention having a spherical exterior sealably received in an isolation member seat having a generally circular sealing surface and installed within the casing of the drilled well illustrated in FIG. 2 to receive and sealably engage the isolation member to create an isolating seal.

FIG. 3 is a sectional elevation of a spherical embodiment of an isolation member 10 of the present invention received in an isolation member seat 44 that has been previously set within the targeted section of a casing 62 of the well 20 to together create an isolating seal. A number of tools exist for setting the isolation member seat 44 within the portion of the casing 62 in which the seal is to be affected, and that those tools and the methods of setting those tools are not within the scope of the present invention. FIG. 3 is provided merely to illustrate the manner in which an embodiment of an isolation member 10 moves through the bore 70 of the casing 62 to engage the isolation member seat 44 after the isolation member seat 44 is set in the portion of the casing 62 and after the isolation member 10 is introduced into the well 20 and moved to the isolation member seat 44. The isolation member 10 and isolation member seat 44 together form a seal to isolate a lower portion of the bore 71 from the upper portion 72 of the bore 70 that is uphole to the isolation member 10 and isolation member seat 44.

Figure 4:
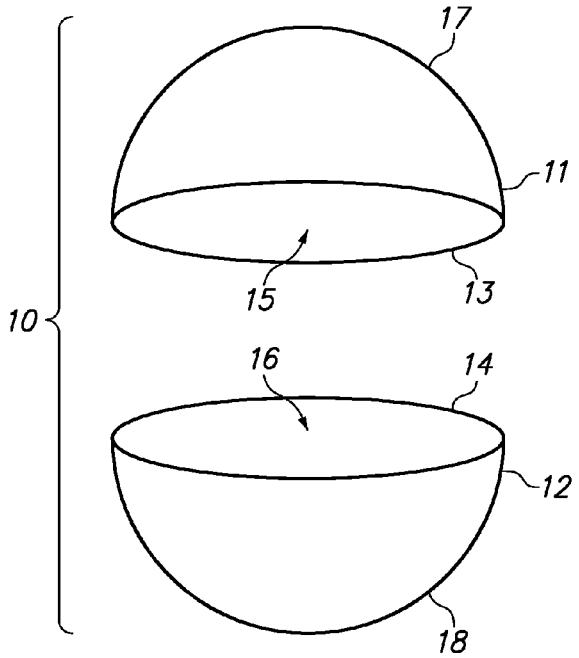
FIG. 4 is an disassembled view of an embodiment of the spherical isolation member of FIG. 3 illustrating how the spherical isolation member may comprise two hemispherical portions that can be secured one to the other to form a spherical isolation member.

FIG. 4 is a sectional view of an embodiment of an isolation member 10 of the present invention. The embodiment of the isolation member 10 of FIG. 4 comprises a hollow interior consisting of a hollow interior 15 of a first hemispherical portion 11 and a hollow interior 16 of a second and matching hemispherical portion 12. The circular rim 13 of the first hemispherical portion 11 is manufactured to correspond in shape for mating engagement with the circular rim 14 of the second hemispherical portion 12. Securing of the first hemispherical portion 11 to the second hemispherical portion 12 provides a spherical isolation member having an exterior surface consisting of the exterior surface 17 of the first hemispherical portion 11 and the exterior surface 18 of the second hemispherical portion 12.

Figure 5:
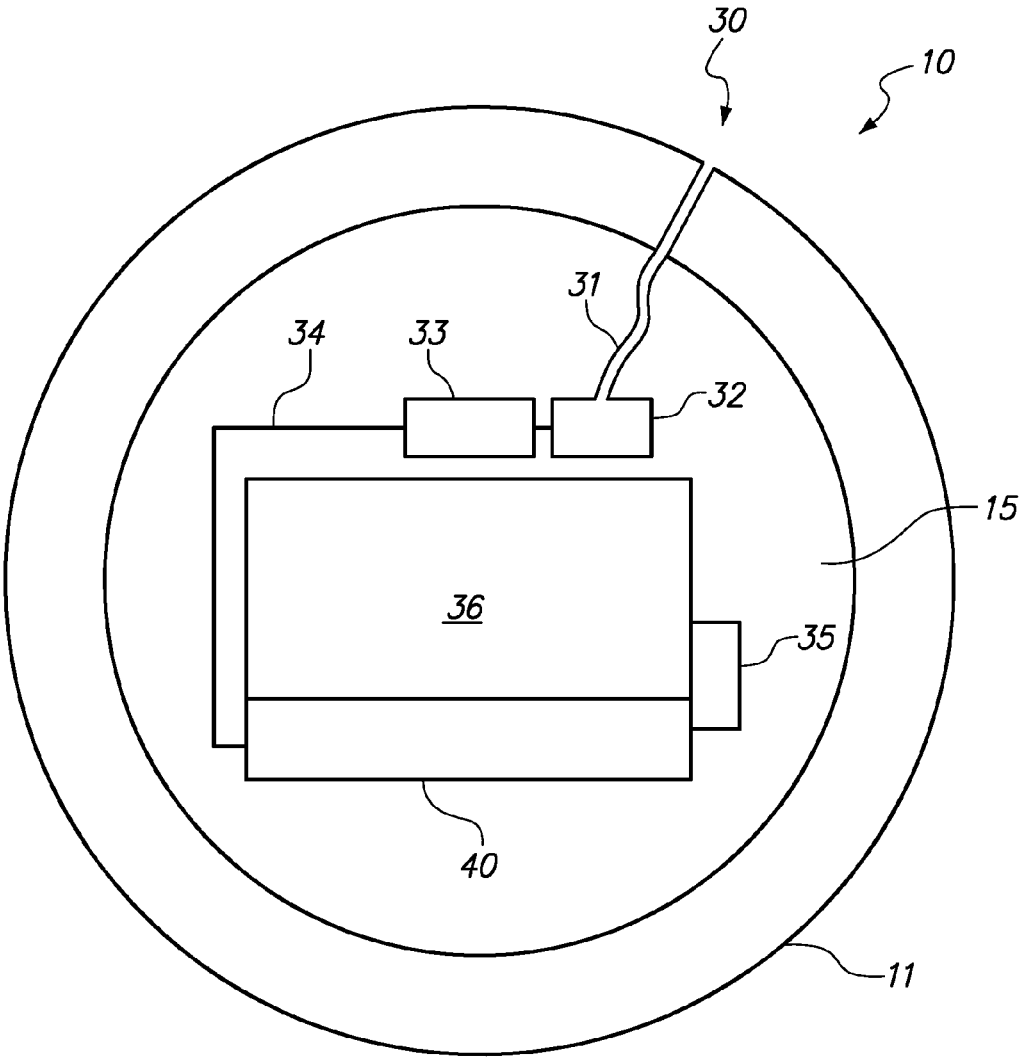
FIG. 5 is a sectional view of an alternate embodiment of a spherical isolation member of the present invention.

FIG. 5 is a plan view of a hollow interior 15 of the open or interior side of the first hemispherical portion 11 of FIG.

4. An aperture 30 in the ceramic hemispherical shell 11 is fluidically connected by a conduit 31 to a pressure sensor 32. The pressure sensor 32 closes a switch upon sensing a predetermined threshold pressure through the aperture 30 and the conduit 31. Upon receiving the signal from the pressure sensor 32, a timer is activated. After a predetermined amount of time from activation, a signal is sent to a detonator to explode the explosive charge within the fracking ball. Upon detonation of the explosive charge 36, the outer shell of the isolation member 10 is fragmented.

Figure 6:
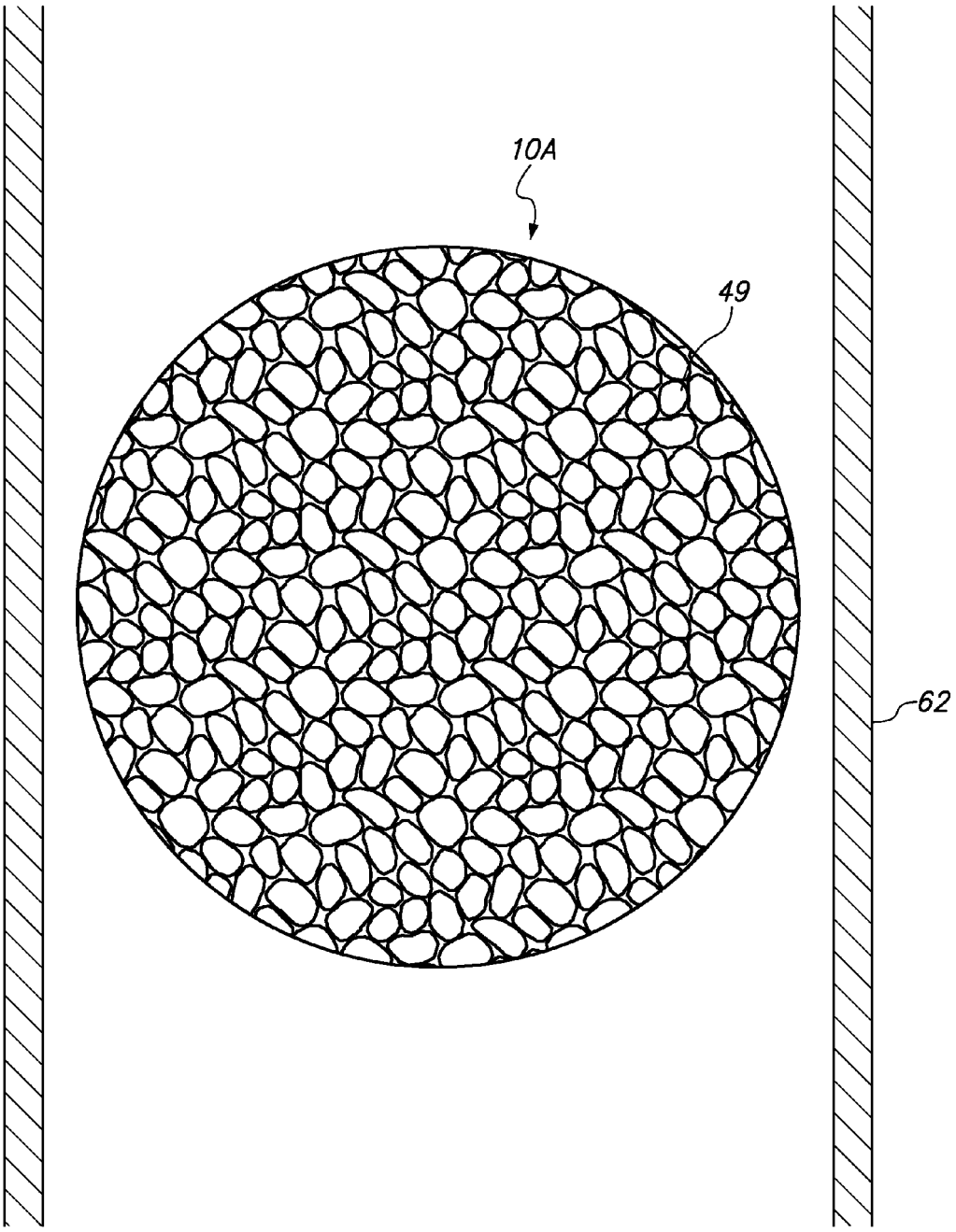
FIG. 6 is an illustration of a fragmented ceramic spherical isolation member resulting from the detonation of the explosive charge contained within an interior chamber (not shown in FIG. 6) of the isolation member of the present invention. The isolation member seat is not shown in FIG. 6.

FIG. 6 illustrates a fragmented spherical ceramic isolation member 10A as it might appear immediately after the moment of detonation of the explosive charge 36 within a hollow interior of the isolation member 10 to fragment the isolation member 10 into numerous fragments 49, which are then dispersed into well fluids moving throughout the casing 62. Fragmentation dramatically increases the cumulative surface area of the isolation member fragments 49 exposed to fluids in the well and will thereby provide a dramatic increase in the rate at which dissolvable materials degrade and dissolve in the well fluids.

Figure 7:
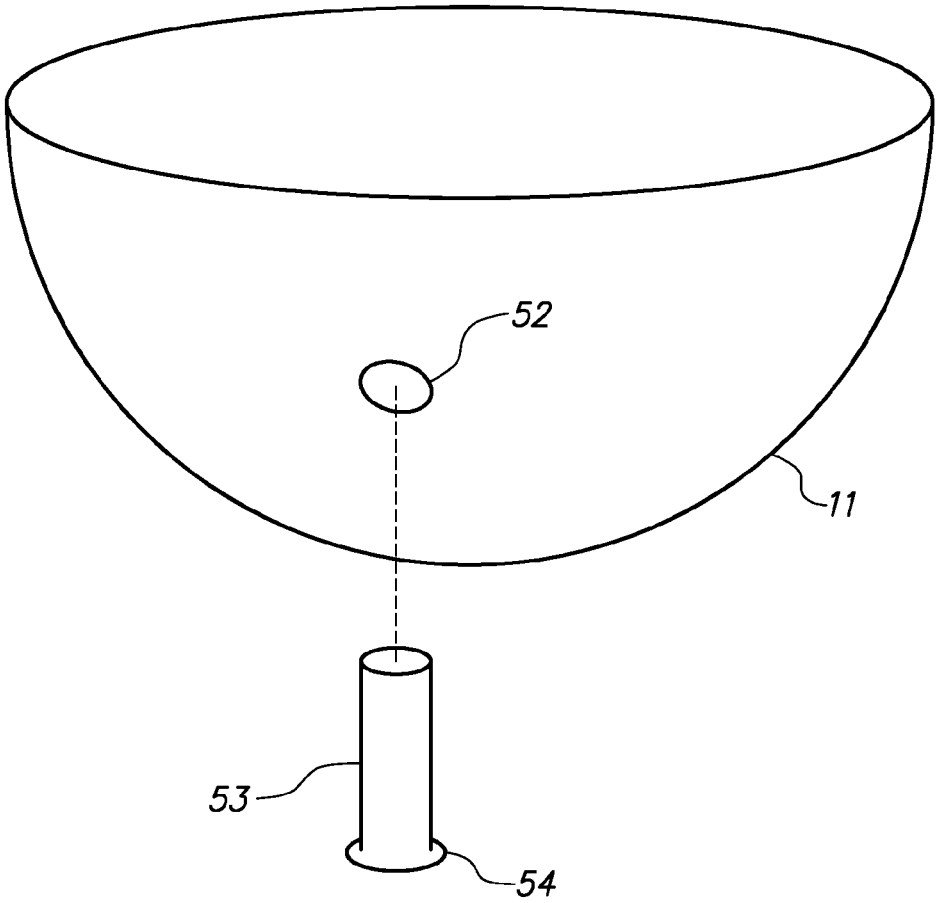
FIG. 7 is an illustration of a safety feature that may be used to enhance the safety of personnel that may handle, prepare and deploy an embodiment of a spherical isolation member of the present invention.

FIG. 7 illustrates a safety feature that may be used to enhance the safety of personnel that may handle, prepare and deploy an embodiment of the isolation member 10 of the present invention. FIG. 7 illustrates a first hemispherical portion 11 of a spherical embodiment of the isolation member 10 having a fuse aperture 52 to receive a safety fuse 53, such as, for example, a pressure sensor. Upon deployment of the isolation member 10 from the surface, the safety fuse 53 can be inserted into and through the fuse aperture 52 to engage and enable a critical connection. For example, but not by way of limitation, the safety fuse 53 may be inserted and seated in the fuse aperture 52 to engage, within the hollow interior 15 of the isolation member 10, a pair of conductive leads bridged by the safety fuse 53 that completes an electrical circuit that will later, after the pressure sensor 32 senses the threshold pressure and after the delay period has run, enable the battery 40 to detonate the preliminary explosive charge 35. Alternately, the safety fuse 53 may engage and enable the circuit 33 so that, upon detection of the threshold pressure by the pressure sensor 32, the circuit 33 will begin the delay period. It will be understood that there are various ways of enabling the explosive charge using a safety fuse 53, that multiple safety fuses 53 may be used. In one embodiment, no safety fuse 53 is used, but this is not recommended for obvious reasons. In the embodiment illustrated in FIG. 7, the safety fuse 53 comprises an enlarged head 54 that limits the extent to which the safety fuse 53 can be inserted through the fuse aperture 52. This head 54 and the safety fuse 53 length may be customized to precisely position the safety fuse 53 relative to the other components 31, 32, 33, 35, 36 and 40 within the isolation member 10.

The configuration of the well 20 and the depth at which the isolation member seat 44 and the isolation member 10 are to be used to determine the size of the isolation member seat 44 and the isolation member 10. The range of sizes of the isolation member 10 may be within the range from 4.45 cm (1.75 inches) to 10 cm (4.0 inches), or larger. The filler material, such as sand, pellets or beads, may comprise particles that vary in size and material, but are preferably in the range from 0.2 mm (0.008 inch) to 1 mm (0.04 inch) in diameter or size. A noncompresible fluid, such as a gel, can also be used as the filler material.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An isolation member for use with an isolation member seat set in a tubular string within a well drilled into the earth's crust to isolate a pressure within a first portion of the well from a pressure in a second portion of the well, the isolation member comprising:

a body of a solid material and having an interior chamber and an exterior surface to engage the isolation member seat;

a battery received within the interior chamber of the body;

an explosive charge including an explosive material received within the interior chamber of the body and coupled for detonation by the battery;

a pressure sensor received within the interior chamber of the body in fluid communication with an aperture extending from the exterior surface of the body to the interior chamber of the body; and a circuit received within the interior chamber and conductively coupled to receive an electrical current from the battery, conductively coupled to receive a signal from the pressure sensor, and conductively coupled to generate, after a predetermined time interval, a detonating current to detonate the explosive charge in response to detecting a predetermined pressure sensed using the pressure sensor;

wherein detonation of the explosive charge fragments the body.

2. The isolation member of claim 1, wherein the solid material of the body is a material that is at least in part dissolvable in one or more fluids introduced into the well.

3. The isolation member of claim 1, wherein the body includes a plurality of body portions that are assembled and secured together to form the body.

4. The isolation member of claim 3, wherein the plurality of body portions includes two hemispherical body portions.

5. The isolation member of claim 4, wherein the plurality of body portions are securable together using an epoxy adhesive.

6. The isolation member of claim 1, wherein the solid material of the body comprises at least one of: zirconium oxide, silicon nitride, tungsten carbide, zirconia toughened alumina, bulk metallic glass and aluminum oxide.

7. The isolation member of claim 1, wherein the isolation member further comprises:

a filler material disposed within the interior chamber of the isolation member.

8. The isolation member of claim 7, wherein the filler material includes at least one of sand, gel and ceramic beads.

9. The isolation member of claim 1, further comprising a fuse aperture in the body for receiving a safety fuse;

wherein the safety fuse enables the detonation of the explosive charge by current provided from the battery.

10. The isolation member of claim 1, wherein the isolation member is spherical.

11. An isolation member for landing within an isolation member seat set in a tubular string to isolate a first portion of a well drilled into the earth's crust from a second portion of the well, the isolation member comprising:

a body of a solid material having an exterior surface to engage the isolation member seat and an interior chamber;

a battery received within the interior chamber;

an explosive charge received within the interior chamber and coupled for detonation by an electrical current from the battery;

a pressure sensor received within the interior chamber and in fluid communication with an aperture extending from the exterior surface to the interior chamber; and a circuit received within the interior chamber to receive a signal from the pressure sensor upon detection by the pressure sensor of a predetermined pressure and to generate a detonation signal from the battery to the explosive charge at a predetermined time interval after the detection of the predetermined pressure by the pressure sensor;

wherein detonation of the explosive charge fragments the isolation member.

12. The isolation member of claim 11, wherein the solid material of the body is at least in part dissolvable in one or more fluids introduced into the well.

13. The isolation member of claim 11, wherein the spherical body includes a plurality of assembled body portions secured together to form the body.

14. The isolation member of claim 13, wherein the plurality of body portions includes two hemispherical body portions.

15. The isolation member of claim 14, wherein the plurality of hemispherical body portions are securable together using an epoxy adhesive.

16. The isolation member of claim 11, wherein the solid material of the body comprises at least one of: zirconium oxide, silicon nitride, tungsten carbide, zirconia toughened alumina, bulk metallic glass and aluminum oxide.

17. The isolation member of claim 11, wherein the isolation member further comprises:

a filler material disposed within the interior chamber of the isolation member.

18. The isolation member of claim 17, wherein the filler material includes at least one of sand, gel and ceramic beads.

19. The isolation member of claim 11, further comprising a fuse aperture in the body for receiving a safety fuse;

wherein the safety fuse enables the detonation of the explosive charge by current provided from the battery.

20. The isolation member of claim 11, wherein the isolation member is spherical.

* * * * *